United States Patent [19]

Notley

[11] Patent Number: 4,705,736

[45] Date of Patent: Nov. 10, 1987

[54] THERMAL DIAZO COMPOSITION

[75] Inventor: Norman T. Notley, Pasadena, Calif.

[73] Assignee: Minnesota Mining and Manufacturing Company, St. Paul, Minn.

[21] Appl. No.: 805,954

[22] Filed: Dec. 5, 1985

[51] Int. Cl.[4] ..... G03C 1/60; G03C 1/52; G03C 1/58

[52] U.S. Cl. ..... 430/138; 430/160; 430/162; 430/176; 430/177

[58] Field of Search ..... 430/160, 162, 176, 177, 430/138

[56] References Cited

U.S. PATENT DOCUMENTS

| | | | |
|---|---|---|---|
| 3,260,599 | 7/1966 | Lokken | 430/176 |
| 3,653,902 | 4/1972 | Notley et al. | 430/176 |
| 3,754,916 | 8/1973 | Winslow et al. | 430/176 |
| 3,920,878 | 11/1975 | Farriss et al. | 428/437 |
| 3,950,171 | 4/1976 | Nihyakuman et al. | 430/160 |
| 4,168,171 | 10/1980 | Fish | 430/176 |
| 4,230,771 | 10/1980 | Phillips | 428/437 |
| 4,230,789 | 10/1980 | Winslow et al. | 430/176 |
| 4,283,477 | 8/1981 | Fletchen et al. | 430/162 |
| 4,411,979 | 10/1983 | Nagamoto et al. | 430/176 |
| 4,452,876 | 6/1984 | Schaeffer et al. | 430/162 |
| 4,482,599 | 11/1984 | Luebbe et al. | 428/212 |
| 4,501,809 | 2/1985 | Hiraishi et al. | 430/138 |

FOREIGN PATENT DOCUMENTS 2059125 5/1971 France .

*Primary Examiner*—Charles L. Bowers, Jr.

*Attorney, Agent, or Firm*—Donald M. Sell; James A. Smith; Lorraine R. Sherman

[57] ABSTRACT

A diazotype sheet is developable solely by heat, the sheet comprising in at least one layer a heat-softenable, organic solvent-soluble resin, an acid-stabilized diazonium salt, at least one azo-coupler compound capable of reacting to form a dye, and an acid neutralizing component immobilized either by encapsulation or by coating as a separate layer with or without a binder. The sheet has incorporated therein at least one plasticizer which is either liquid at room temperature (i.e., 20° to 25° C.) or fusible at a temperature between room temperature and the development temperature.

13 Claims, No Drawings

THERMAL DIAZO COMPOSITION

FIELD OF THE INVENTION

This invention relates to thermally-developable diazotype materials. In another aspect, a method for making a diazo reproduction of an image is disclosed.

BACKGROUND ART

Diazotype imaging materials contain at least two active agents and usually require a third active agent to perform well. The first two agents are an acid-stabilized diazonium salt and an azo-coupler compound. The diazonium salt is stabilized against spontaneous reaction with itself and the azo-coupler by the presence of an acid environment. The image produced by diazotype materials is formed from the resulting dye of a reaction between a diazonium salt and the azo-coupler compound. A diazotype sheet containing only these two agents would not be of significant use in competition with modern imaging techniques because a protracted development time would be necessary to overcome the stabilization of the diazonium salt, or reduced amounts of acid would have to be used which would render the sheet less storage stable and of little practical use. It has therefore been the practice of the art to add active or latent acid-neutralizing compounds (basic materials) into the sheet in order to enable the diazonium salt and the azo-coupler to couple and form a dye more easily. The acid-neutralizing compounds have commonly been made available for neutralization in various manners including the direct application of bases in the gaseous state (e.g. ammonia) or in solution. In ammonia processed diazo systems, French Pat. No. 2,059,125 discloses that certain plasticizers are useful as development accelerators. It is shown that development times range from 10 to 40 seconds.

U.S. Pat. No. 3,754,916 discloses that benzimidazole compounds can be used as an acid-neutralizer and provides a storage stable material when the benzimidazole compound is included within a heat-softenable binder and also provides excellent imaging characteristics to diazotype sheets. Typical reaction times for the diazotype sheets shown were at least 40 seconds at 260° F. (126° C.) to react all of the dye forming components in the sheet. U.S. Pat. No. 4,168,171 discloses the use of imidazoles, and U.S. Pat. No. 4,230,789 teaches use of certain imidazolines as neutralizing agents for thermally developable diazo sheets. Comparable development times are disclosed.

Sheets of higher speed can be made by reducing the amount of diazonium salt (for quicker exposure) and increasing the amount of acid-neutralizer and/or decreasing the amount of acid (for quicker development). However, when such optimization has been made, it is found that in rapid processing with development following quickly upon exposure, there is a problem with the nitrogen from the diazo decomposition. It forms blisters or, in extreme cases, a very large number of small occlusions more usually known as vesicules. Such defects are unacceptable.

SUMMARY OF THE INVENTION

Briefly, the present invention provides a diazotype sheet developable solely by heat, the sheet comprising in at least one layer a heat-softenable, organic solvent-soluble resin, an acid-stabilized diazonium salt, at least one azo-coupler compound capable of reacting to form a dye, and an acid neutralizing component immobilized either by encapsulation or by coating as a separate layer with or without a binder, and having incorporated in said sheet at least one plasticizer compatible with said resin which is either liquid at room temperature (i.e., 20° to 25° C.) or fusible at a temperature between room temperature and the development temperature.

Now it has been discovered that the nitrogen vesicule problem which is present during high speed development can be eliminated and the development itself can be made even more rapid by incorporating in the resin of at least one of the layers at least one plasticizer that is a liquid at room temperature or is fusible to a liquid at the temperature of development. The effect of suppressing vesiculation by softening the resin with a plasticizer is surprising since it was well known that vesiculation is promoted by higher temperatures and it has been said frequently that the essential effect of the higher temperature is to soften the resin.

As used in this application:

"plasticizer" means a non-volatile organic compound incorporated into a material to increase its workability, flexibility, or distensibility;

"liquid plasticizer" means a plasticizer which is liquid at ambient temperatures (20° to 25° C.);

"fusible plasticizer" means a plasticizer which is solid at and just above ambient temperatures but has a melting point substantially below the preferred development temperature; (The preferred plasticizers do not contribute to instability in the storage condition but do contribute to increase of development rate and suppression of vesiculation during development); and "high speed developable" means capable of being developed with a very short time elapsed between exposure and complete development.

DETAILED DESCRIPTION

The present invention provides a high speed developable, heat reactive diazotype sheet having at least two layers, with one layer coated upon the other, one of the layers comprising a heat-softenable binder material and an acid-stabilized light sensitive diazonium salt capable of reacting with an azo-coupler compound to form a dye, and the other layer comprising a heat-softenable binder material and an acid-neutralizer component capable of providing basic equivalents in an amount at least sufficient to neutralize the acid stabilization of the diazonium salt in the sheet and to render the acid-stabilized diazonium salt reactive with the azo-coupler compound, at least one of the layers containing an azo-coupler, and at least one of the layers containing at least one plasticizer compatible with said binders that is liquid at the temperature of development. The diazotype sheet of the invention is high speed developable in 0.1 to 30 seconds at 100° to 200° C., most preferable in 0.1 to 1.5 seconds at 120°–170° C.

The all-around performance of a plasticizer is usually related to a balance of certain properties, i.e., compatibility with the resin, efficiency in flexibilizing, low volatility, and resistance to extraction. It is particularly important that a plasticizer be essentially non-volatile, i.e., have very low vapor pressure, a condition which is usually achieved by selecting high boiling point materials. While some very effective plasticizers are solid, and indeed some solid plasticizers are especially useful in the practice of this invention, it is essential that the plasticizer be liquid at the temperature of development, which preferably is in the range of 100°-200° C. Thus the plasticizer boiling or decomposition point will generally be above 200° C. while the melting point will be below 125° C., and will preferably be below 70° C.

The plasticizer can be present in at least one layer of the diazotype sheet. Preferably, it is introduced in the layer containing the diazonium salt. It is to be recognized that a plasticizer as described herein is capable of migrating from one layer to another. It can be introduced into any layer of the diazo-type sheet so long as there is no barrier to its migration to whichever layer vesiculates most readily. Addition of a plasticizer appears to make the resin more gas permeable so as not to trap nitrogen. A plasticizer also is believed to increase the rate of pre-coupling of the diazonium salt and coupler.

Use of a plasticizer as taught in the present invention provides diazotype sheets which are high speed developable with essentially no vesiculation, the diazotype sheets being shelf stable for at least 8 months at temperatures as high as 24° C. (75° F.).

Many of the plasticizers useful in the present invention are esters of dibasic carboxylic acids (preferably the acids having 2 to 20 carbon atoms) such as phthalic, adipic, sebacic, maleic, and succinic acids which include diphenylphthalate, dihexylsebacate, dilauryladipate, diamylmaleate and 2-ethylhexylsuccinate. Other excellent classes of ester plasticizers are the benzoates, butyrates, hexoates, acetates, glutarates, laurates and oleates. Among the esters, those of mono, di, and polyfunctional alcohols, preferably those of the glycols, of glycerol and of sucrose are useful. In addition to the esters, other classes of plasticizers which are useful include the hydrocarbons and chlorinated hydrocarbons having at least 12 carbon atoms, preferably 12 to 30 carbon atoms, and amides, especially sulfonamides, preferably having 7 to 30 carbon atoms, e.g., toluenesulfonamide, toluene ethyl sulfonamide, and sulfonamide-formaldehyde. Yet other plasticizers may be found, e.g., in Modern Plastics "Guide to Plastics" pages 170–179 pub. McGraw Hill 1983 Monomeric, oligomeric, and polymeric plasticizers useful in the invention generally have number average molecular weights in the range of 90 to 5000, preferably 125 to 5000.

The physical and chemical characteristics of plasticizers discussed above provide for a broad range of plasticizers from which the optimum choice can be made only after the resin binder has been selected. The resin and the plasticizer must be compatible over a broad range of temperatures and preferably also over a broad range of plasticizer/resin ratios. For compatibility testing the resin and the plasticizer are dissolved in a common organic solvent (such as methanol, toluene, and butanone), coated as a thin film and dried. Incompatibility may be detected as translucency or even opacity in the dried film, but more usually as exuding of the plasticizer to form droplets or a liquid surface film or blooming as a solid surface crust which may be detectable in an hour or less after drying, or may take several days.

The quantity of plasticizer to be used is generally not critical, but must be selected for the particular combination of resin and plasticizer. The amount must be selected as sufficient to be effective in supressing vesiculation for the time and temperature appropriate for development, but preferably no more than sufficient since stability or shelf life of the coating decreases with increasing plasticization. Generally the preferred amount is found to be between 2 and 60% by weight of the resin in the layer and preferably between 5 and 30%.

A particularly advantageous plasticization for the purposes of this invention has been achieved by combining a plasticizer which is liquid throughout the ambient through development temperature range with one which is solid at ambient temperatures but melts somewhere between ambient and the development temperature. Either the liquid or solid plasticizer can be useful alone in amounts, as mentioned above, in the range 2 to 60 weight percent of the resin layer. A fusible plasticizer may not be of sufficient effectiveness to provide the desired effects on its own. However, it has little or no adverse effect on the film stability and so may be added in a relatively large quantity. As much as 40 weight percent (preferably 10 to 40 weight percent) of a fusible plasticizer compared to resin weight can be added to a film which already has 30 weight percent (preferably 5 to 30 weight percent) of liquid plasticizer. When both a liquid and a fusible plasticizer are present, a total amount of plasticizer in the range 2 to 70 weight percent, preferably 15 to 70 weight percent, of the resin layer can be used.

Diazonium salts which find utility in this invention are those which are capable of coupling with azo-coupler compounds in weakly basic environments to form dyes. Of the many diazonium salts which may be used in this invention, the following have given good results:

p-amino-N-benzyl-N-ethyl-benzenediazonium chlorostannate, p-amino-N-benzyl-N-ethylbenzenediazonium chloro-zincate, 3-chloro-4-diethylaminobenzenediazonium chlorozincate, p-diethylaminobenzenediazonium fluoroborate, p-diethylamino-2-ethoxybenzenediazonium chlorozincate, 4-diethylamino-2-methylbenzenediazonium chlorozincate, p-morpholinobenzenediazonium fluoroborate, p-diazo-N-methyl-N-hydroxyethylaniline zinc chloride, p-diazo-N-ethyl-o-toluidine zinc chloride, p-diazo-N-diethyl-m-phenetidine zinc chloride, p-diazomorpholino-2,5-diethoxybenzene zinc chloride, p-diazomorpholino-2,5-dibutoxybenzene boro fluoride, p-diazo (4'-toluyl)-mercapto-2,5-diethoxybenzene zinc chloride, 4-diazo-1',2,5-triethoxydiphenyloxalate, p-diazomopholino-2,5-dibutoxybenzene zinc sulfate, p-diazodimethyl aniline 1/1-ZnCl2,p-diazo diethylaniline zinc chloride, p-diazo-N-hydroxyethyl-N-ethylaniline-½ zinc chloride, p-diazo-N-benzylaniline zinc chloride, 4-diazophenylmorpholine zinc chloride, 1-diazo-4-benzoylamino-2,5-diethoxybenzene zinc chloride.

Preferred diazonium salts include:

p-diazomorpholino-2,5-diethoxybenzene borofluoride, p-diazomorpholino-2,5-dibutoxybenzene borofluoride, p-diazomorpholino-2,5-dibutoxybenzene zinc sulfate, 4-diazophenylmorpholine zinc chloride. Light-sensitive diazonium salts are preferably used.

Azo-coupling compounds which find utility in this invention are those which will couple with diazonium salts in weakly basic environments to form dyes. Such couplers include: 2,3-dihydroxy naphthalene, 2,4-dihydroxynaphthalene-6-sulfonic acid sodium salt, 2,7-dihydroxynaphthalene, 7,7-dihydroxynaphthalene, phloretin, acetoacetanilide, aceto-acet-o-ansidide, 3-methyl-p-sulfophenyl-5-pyrazolone, aceto-acet-2,5-dimethoxyanilide, aceto-acete-p-toludide, aceto-acet-2,4-xylidide,2,6-dihydroxy toluene, 3-methyl-1-phenyl-5-pyrazolone, 2'-chloroacetanilide, ethylenediaminebisacetoacetamide, N,N-ethylenebisacetoacetamide, α-naphtol, β-naphtol, 1,4-dihydroxynaphthalene.

Azo-couplers commonly used in the dying of textiles have proven especially useful, such as the following: 3-hydroxy-2-naphtho-o-phenetitide, 3-hydroxy-2-naphtho-o-toluidide, 5'-chloro-3-hydroxy-2',4'-dimethoxy-2-napthanilide, 3-hydroxy-2',5-dimethoxy-2-naphthanilide, 3-hydroxy-2-naph-o-anisidide. Light-sensitive azo-coupler compounds may be used, as taught in U.S. Pat. No. 3,094,417.

Two or more azo coupler compounds may be incorporated within the diazotype sheet of the present invention to produce dyes which together exhibit desirable spectral absorption characteristics. For example, in a preferred embodiment, the dyes resulting from the coupling of p-diazomorpholino-2,5-diethoxy borofluoride with acetoacetanilide, 2,3-dihydroxynaphthalene, and 3-hydroxy-2-naphtho-o-toluidide are yellow, reddish-purple, and cyan, respectively, and together form substantially black images.

It is often desirable to incorporate acidic compounds, such as oxalic acid, in diazotype sheets which contain highly-reactive diazonium salts for the purpose of inhibiting self-coupling and pre-coupling reactions. Diazotype sheets which contain less highly-reactive diazonium salts generally require proportionately reduced amounts of acidic compounds and many diazonium acid-salts exhibit sufficient stability without the addition of other acidic compounds.

The acid-neutralizer component can be any acid-neutralizer known in the art to be useful in diazotype sheets. Preferable acid-neutralizer components are benzimidazoles, imidazoles and imidazolines, for example, as disclosed in U.S. Pat. Nos. 3,754,916; 4,168,171; and 4,230,789.

A binder material, normally polymeric, is preferably used to contain the reactive components in layers in the diazotype sheets of the present invention. The binder materials and barrier materials are preferably thermoplastic and soften sufficiently at reasonable development temperatures to permit acid-neutralizing compounds to readily migrate therethrough. Thermoplastic binder materials in addition should be sufficiently rigid at normal storage temperatures to hinder such migration. It is desirable that the binder materials used in the present invention be capable of forming continuous films. Examples of such polymeric binder materials include polyester, polyvinyl chloride acetate, polystyrene, cellulose acetate butyrate, cellulose acetate propionate, polymethylmethacrylate, etc. Such binder materials are preferably chosen to be compatible with the components incorporated therein, i.e., capable of forming a single phase system with such components, and permit the ready migration of acid-neutralizing compounds therethrough upon heating. However, polymeric binder materials which are incompatible with the components contained therein, such as polymeric lattices, may often be advantageously utilized. Binder materials which permit the migration therethrough of chemical compounds such as acid-neutralizing compounds, couplers, and the like are generally known to the art, and the selection therefrom is not critical to the present invention.

The supporting substrates for the layers of the present invention may be of any suitable material such as plastic film, glass, paper, metal, cloth, wood, etc. Plastic films, such as polyester and cellulose triacetate, are preferred. The substrates desirably should have a heat-distortion temperature sufficiently high to permit reasonable development temperatures to be used without damage thereto. It is contemplated, however, that substrates having lower heat-distortion temperatures may be desirable, as, for example, when a wrinkled design pattern is desired. It is further contemplated that a separate supporting layer may be advantageously eliminated in some cases, as when at least one of the binder materials is a self-supporting film.

The diazotype sheets of the present invention may be prepared by a variety of methods, such as consecutively coating polymer emulsions containing reactive components upon a substrate to form layers; laminating together reactive component-containing layers, etc. Preferably, however, the reactive components and polymeric binder material for each layer are combined in a solution which is coated and dried to form a layer. The solvent for each solution is preferably a non-solvent for the binder material of the preceding layer, thereby avoiding the migration which might otherwise occur should a solvent be capable of dissolving the binder material of the preceding layer to liberate the reactive components contained therein.

The present invention provides a method for providing a record of a light image comprising the steps of:

(a) providing a diazotype sheet developable solely by heat, the sheet comprising in at least one layer a heat-softenable, organic solvent-soluble resin, an acid-stabilized diazonium salt, at least one azo-coupler compound capable of reacting to form a dye, and an acid neutralizing component immobilized either by encapsulation or by coating as a separate layer with or without a binder, and having incorporated in said sheet at least one plasticizer which is either liquid at room temperature or fusible at a temperature between room temperature and the development temperature, (b) exposing said sheet imagewise to UV radiation for a time sufficient to cause said diazonium salt to decompose, and (c) heating said exposed sheet for a time sufficient to develop an image.

The present invention also provides a method for providing a record of a heat image comprising the steps of:

(a) providing a diazotype sheet developable solely by heat, the sheet comprising in at least one layer a heat-softenable, organic solvent-soluble resin, an acid-stabilized diazonium salt, at least one azo-coupler compound capable of reacting to form a dye, and an acid neutralizing component immobilized either by encapsulation or by coating as a separate layer with or without a binder, and having incorporated in said sheet at least one plasticizer which is either liquid at room temperature or fusible at a temperature between room temperature and the development temperature, (b) exposing said sheet selectively to a pattern of heat for a time sufficient for said diazonium salt to react with said azo-coupler compound, and (c) exposing said sheet overall to UV radiation for a time sufficient to decompose previously unreacted diazonium salt.

The invention is particularly useful in high speed web development and most especially for high speed 16 mm microfilm duplication. The present invention is also useful in providing duplicate copies of original films which may be, for example, silver, diazo, vesicular, or electrophotographic. Such imagery may be in the form of 16 mm, 35 mm, or 105 mm rolls or convenient sized sheets. Optical densities of 3.0 or higher, preferably in the range of 1.6 to 2.6, can be obtained.

Objects and advantages of this invention are further illustrated by the following examples, but the particular materials and amounts thereof recited in these examples, as well as other conditions and details, should not be construed to unduly limit this invention. All percents and parts are by weight unless otherwise indicated. All plasticizers of the invention used in the examples have b.p.'s above 200° C. at atmospheric pressure.

EXAMPLE 1 (comparative example)

Imidazole (1.5 g) was dissolved in a solution containing 13 g of styrene-butadiene resin (Pliolite TM S-5D, Goodyear Chemicals, Akron, Ohio) with 20.4 g 2-butanone and 5.1 g toluene, coated from a 51 micrometer (2 mil) orifice onto 102 micrometer thick (4 mil) polyester film, dried 2 minutes at 90° C. to provide a layer of weight about 10 g per sq. meter.

A second solution was made in which 1.36 g of p-diazo-2,5-diethoxy-4-morpholino benzene borofluoride with 0.5 g 5-sulfosalicylic acid, 0.44 g 3-hydroxy-2-methyl-2-naphthanilide-o-toluide, 0.44 g 3-oxynapthoic acid o-phenitide and 7.49 g polyvinylbutyral were dissolved in sufficient 3:1 methanol/ethanol to achieve a viscosity of 300 cps. A coating was made over the imidazole-containing pre-coat described above with an orifice of approximately 64 micrometers (2.5 mil) and dried for two minutes at 65° C. to give a film of weight of 5.5 g/m$^2$.

The film was exposed imagewise to ultra-violet light for 8 seconds on a Scott 716 (Scott Graphics, South Hadley, MA) and developed immediately with a 3 sec. pass at 145° C. on a Canon 360VS heat developer (Canon, Inc., Tokyo, Japan). The non-exposed areas developed to a dark color of density about 1.8, but in the exposed areas an unwanted density was caused by bubble formation, some large but some small and of the type known as vesicules.

EXAMPLE 2 (comparative example)

The activator coating solution of Example 1 containing imidazole was replaced by one in which 1.8 g 2-phenylimidazoline was dissolved in a solution containing 13 g polyester Vitel TM 200 (Goodyear Chemicals, Akron, Ohio) with 20.4 g 2-butanone and 5.1 g toluene. In all other respects the film was prepared and tested in the same way as before. It gave similar density and similar undesired vesicule formation.

EXAMPLE 3

The coating of Example 1 was modified by including in the second solution 2.5 g triethyleneglycol-di-2-ethylbutyrate (liquid plasticizer, m.p. −65° C.) which provided plasticizer in an amount 33.3 percent by weight of the amount of resin present. The density formed as before in the non-exposed areas during a 3 second pass at 145° C. but the exposed areas remained clear and free of bubbles and vesicules. High speed development times in the range of 0.1 to 1.5 seconds were achieved using development temperatures of 120° to 170° C.

EXAMPLE 4

The coating of Example 1 was modified by including in the second solution 2.5 g polyethyleneglycol-di-2-ethylhexoate (liquid plasticizer, m.p. −55° C.). The processed image was of good quality, equivalent to that of Example 3 after a 3 second pass at 145° C. High speed development times in the range of 0.1 to 1.5 seconds were achieved using development temperatures of 120° to 170° C.

EXAMPLES 5-7

The film of Example 2 was modified by including in the second solution the amounts shown in TABLE I, below, of sucrose octaacetate (SOA) as a solid plasticizer with a melting point 72° C., and triethyleneglycol-di-2-ethylbutyrate (TEGEB) as a liquid plasticizer.

TABLE I

| | SOA | | TEGEB | | Image Quality | |
|---|---|---|---|---|---|---|
| Example | Amount | % of resin | Amount | % of resin | non-exp. | exp. |
| 5 | 1.5 g | 20% | 1.5 g | 20% | good | good |
| 6 | 1.5 g | 20% | 1.12 | 15% | good | good |
| 7 | 1.5 g | 20% | 0.38 | 5% | good | bubbles |

The film of Example 6 was also evaluated quantitatively for its ability to resist vesiculation when development followed quickly after exposure. Samples were spliced into a web which could be transported at a steady speed from a 400 watt Sylvania arc lamp where complete exposure took less than a second to a metal roll heated to 138° C. (280° F.) where complete development took less than a second. With a fixed distance between exposure and development stations, the speed was varied to determine the critical time needed. With the plasticized film of Example 6 the minimum time required varied from 0.39 to 0.75 seconds. With the non-plasticized film of Example 2 the least time required was 2.30 to 2.82 seconds. SOA in amounts of 30 and 40 weight percent of the resin can be used to give similar good quality images.

EXAMPLES 8-15

The film of Example 2 was modified with additions to the second solution of various solid platicizers in the amount of either 2.25 g or 3.75 g to provide 30% or 50% ratio of plasticizer to resin. All films gave good Dmax of 1.7 to 2.0 but varied in the usefulness of the exposed portion of the image. Times between exposure and completed development ranged from 0.1 to 1.5 seconds at a temperature of 120° to 170° C. The data is shown in TABLE II, below.

TABLE II

| Example | Plasticizer (P) | m.p. (°C.) | Weight % of (P) | Image quality |
|---|---|---|---|---|
| 8 | neopentylglycoldi-benzoate | 49 | 30% | good |
| 9 | neopentylglycoldi-benzoate | 49 | 50% | good |
| 10 | diphenylphthalate | 70 | 30% | sl. bubbles (marginal) |
| 11 | diphenylphthalate | 70 | 50% | good |
| 12 | glyceroltribenzoate | 71 | 30% | marginal |
| 13 | glyceroltribenzoate | 71 | 50% | marginal |
| 14 | pentaerythritoltetra-benzoate | 99 | 30% | marginally incompatible |
| 15 | pentaerythritoltetra-benzoate | 99 | 50% | incompatible |

The data of TABLE II show that fusible plasticizers alone are useful. Examples 14 and 15 show that incompatibility of plasticizer and resin adversely affects the image quality.

EXAMPLE 16

The film of Example 2 was modified by including in the second solution 4.5 g triethyleneglycol-di-2-ethylbutyrate which provided plasticizer in the amount of 60% by weight of the weight of resin. High speed development with freedom from vesiculation was obtained under conditions equivalent to those of Example 3 where the same plasticizer was at 33.3%. The film of this example showed a gradual Dmin increase with aging.

EXAMPLE 17

The film of Example 2 was modified by including in the second solution 3.75 g triethyleneglycol-di-2ethylbutyrate and 1.5 g sucrose octaacetate, which combines liquid and fusible plasticizers to a total of 70% by weight of the weight of resin. Evaluation as in Example 16 gave equivalent results for performance and stability.

EXAMPLES 18–27

The film of Example 2 was modified by including in the second solution a variety of liquid plasticizers in an amount of 2.25 g to provide 30% by weight of the weight of resin. All of the plasticizers gave the desired effect, although they differed somewhat in their efficiency. This was evaluated by coating the second solution at several thicknesses and running samples at 13.7 meters (45 feet) per minute in a film duplicator. Thicker films were desirable because they gave higher image densities, but at some thicknesses vesiculation occurred in the exposed areas, which was unacceptable. A plasticizer reduced the vesiculation tendency, allowing higher thicknesses to be utilized and consequently higher image densities as recorded in the TABLE II below.

TABLE III

| Example | | Limiting density for freedom from vesiculation |
|---|---|---|
| 18 | acetyltributylcitrate | 1.2 |
| 19 | triethyleneglycoldiethylhexoate | 1.4 |
| 20 | di-2-ethylhexylphthalate | 1.2 |
| 21 | di-2-ethylhexylhexahydrophthalate | 1.2 |
| 22 | butylphthalylbutylglycolate | 1.4 |
| 23 | tri-2-ethylhexylphosphate/ trioctylphosphate | >1.9 |
| 24 | di(ethylhexyl)adipate | >1.9 |
| 25 | 2,2-(2-ethylhexanimido)di-ethyl-di-2-ethylhexoate | >1.9 |
| 26 | triethyleneglycol-di-2-ethylbutyrate | >1.9 |
| 27 | none | <1.0 |

The data in TABLE III show that all plasticizers used were effective and images of very high density were made without interference by vesiculation. In the absence of plasticizer even low densities were not possible without vesiculation (see Example 2).

EXAMPLE 28

The coating of Example 1 was modified by including in the second solution 0.45 g triethyleneglycol-di-2-ethylbutyrate which provided plasticizer in the amount of 6 percent by weight of the resin present. Using the procedure of Example 1, good density formed in the non-exposed areas during a 3-second pass at 145° C. and the exposed areas remained clear and free of bubbles.

Various modifications and alterations of this invention will become apparent to those skilled in the art without departing from the scope and spirit of this invention, and it should be understood that this invention is not to be unduly limited to the illustrative embodiments set forth herein.

I claim:

1. A diazotype sheet developable solely by heat, the sheet comprising in at least one layer a heat-softenable, organic solvent-soluble resin, an acid-stabilized diazonium salt, at least one azo-coupler compound capable of reacting to form a dye, and an acid neutralizing component immobilized either by encapsulation or by coating as a separate layer with or without a binder, and having incorporated in at least one layer of said diazotype sheet at least one plasticizer compatible with said resin, said plasticizer consisting essentially of a compound which is either liquid at room temperature or fusible at a temperature between room temperature and the development temperature, wherein said diazotype sheet is shelf stable for at least 8 months at temperatures as high as 24° C.

2. A heat reactive diazotype sheet developable solely by heat having at least two layers, with one layer coated upon the other, one of said layers comprising a heat-softenable, organic solvent-soluble binder material and an acid-stabilized light sensitive diazonium salt capable of reacting with an azo-coupler compound to form a dye, and the other of said layers comprising a heat-softenable organic solvent-soluble binder material and an acid-neutralizer component capable of providing basic equivalents in an amount at least sufficient to neutralize said acid stabilization of said diazonium salt so as to provide a weakly basic environment for the diazonium salt in the sheet and to render said acid-stabilized diazonium salt reactive with said azo-coupler compound, at least one of said layers containing an azo-coupler, and at least one layer of said diazotype sheet containing at least one plasticizer compatible with said binder, said plasticizer consisting essentially of a compound that is liquid at room temperature or fusible at a temperature between room temperature and the temperature of development, wherein said diazotype sheet is shelf stable for at least 8 month at temperatures as high as 24° C.

3. The diazotype sheet according to claim 1 wherein said plasticizer is an ester of a dibasic carboxylic acid, a hydrocarbon or chlorinated hydrocarbon, or an amide or sulfonamide.

4. The diazotype sheet according to claim 1 wherein said plasticizer is a liquid at room temperature.

5. The diazotype sheet according to claim 1 wherein said plasticizer is solid at room temperature.

6. The diazotype sheet according to claim 4 wherein said plasticizer is present in an amount in the range of 2 to 60 weight percent of the resin in the layer.

7. The diazotype sheet according to claim 5 wherein said plasticizer is present in an amount in the range of 2 to 60 weight percent of the resin in the layer.

8. The diazotype sheet according to claim 4 wherein said liquid plasticizer is triethyleneglycol-di-2-ethylbutyrate, or polyethyleneglycol-di-2-ethylhexoate.

9. The diazotype sheet according to claim 5 wherein said solid plastizer is neopentylglycoldibenzoate, diphenylphthalate, sucrose octaacetate, glyceroltribenzoate, or pentaerythrytoltetrabenzoate.

10. The diazotype sheet according to claim 1 wherein said plasticizer comprises at least one liquid and at least one fusible plasticizer.

11. The diazotype sheet according to claim 10 wherein said plasticizers are present in an amount in the range of 2 to 70 weight percent of the resin present in the layer.

12. The diazotype sheet according to claim 11 where said range is 15 to 70 weight percent.

13. The diazotype sheet according to claim 1 capable of development in 0.1 to 1.5 seconds at a temperature range of 120° C. to 170° C.

* * * * *